US006964499B2

(12) United States Patent
Colip et al.

(10) Patent No.: US 6,964,499 B2
(45) Date of Patent: Nov. 15, 2005

(54) LIGHT EMITTING DIODE CARRIER

(75) Inventors: Matthew S. Colip, Columbus, IN (US); Bradley T. Baker, Nashville, IN (US)

(73) Assignee: Valeo Sylvania L.L.C., Seymour, IN (US)

( * ) Notice: Subject to any disclaimer, the term of this patent is extended or adjusted under 35 U.S.C. 154(b) by 164 days.

(21) Appl. No.: 10/657,834

(22) Filed: Sep. 9, 2003

(65) Prior Publication Data

US 2005/0052864 A1 Mar. 10, 2005

(51) Int. Cl.[7] ..... F21V 21/00
(52) U.S. Cl. ..... 362/249; 362/294; 362/800
(58) Field of Search ..... 362/252, 555, 362/547, 240, 294, 373, 227, 545, 249, 800, 676, 702, 707, 709; 313/498–500, 512, 25, 111; 361/676, 702, 707, 709, 805, 806, 720

(56) References Cited

U.S. PATENT DOCUMENTS 5,632,551 A * 5/1997 Roney et al. ..... 362/485
6,367,949 B1 * 4/2002 Pederson ..... 362/240
6,641,284 B2 * 11/2003 Stopa et al. ..... 362/240
6,827,468 B2 * 12/2004 Galli ..... 362/294

* cited by examiner

*Primary Examiner*—Stephen Husar
*Assistant Examiner*—Hargobind S. Sawhney
(74) *Attorney, Agent, or Firm*—William E. Meyer

(57) ABSTRACT

A lamp assembly (10) has a carrier (12) with a front side (14) and a backside (16) provided with a plurality of passages (18) therethrough. A circuit board (20) includes a first surface (22) and a second surface (24). A plurality of light sources (26) is mounted on the first surface (22), and the first surface (22) of the circuit board (20) is aligned with the backside (16) of the carrier (12). The plurality of light sources (26) is aligned with the plurality of passages (18) in one-to-one relationship. At least one heat sink (28) is mounted in thermal contact with at least one of the plurality of light sources.

7 Claims, 1 Drawing Sheet

LIGHT EMITTING DIODE CARRIER

TECHNICAL FIELD

This invention relates to lamp assemblies and more particularly to lamp assemblies for use with automobiles. Still more particularly the invention relates to lamp assemblies employing light emitting diodes (LEDs) and flexible circuit boards uniquely mounted upon a carrier.

BACKGROUND ART

The use of LEDs has dramatically increased in recent years, particularly for automotive uses, because of their long life and relatively low direct current power consumption. A prime example has been the use of LED lamps for the high mount taillight required on automobiles and light trucks. Design problems have occurred when using these lamps because of the mounting requirements and the esthetics being undermined by the visibility of the circuit board and various electrical connections.

Additionally, it has been difficult to achieve consistent mounting without damaging the LEDs themselves, and in mounting the required heat sinks, which often were trapped between the printed circuit board (PCB) and a carrier, reducing the heat sink access to air and adversely effecting their cooling function. Still other problems arose because of the tolerance build-up between PCBs, carriers and heat sinks, which tolerances added to the LED focal point positional tolerance making it more difficult to achieve the desire optical performance, particularly where additional optics, such as Fresnel lenses, were being used. If reflector cups were used with the LEDs it was possible for the PCB to come into contact with the metallized reflectors, posing a risk for short circuits and failure of the lamp assembly.

DISCLOSURE OF INVENTION

It is, therefore, an object of the invention to obviate the disadvantages of the prior art.

It is another object of the invention to enhance the assembly and operation of lamps.

It is another object of the invention to provide adequate heat-sinking for a plurality of lamps.

It is yet another object of the invention to control tolerances in multiple piece lamp assemblies to assure design quality.

These objects are accomplished, in one aspect of the invention, by the provision of a lamp assembly that comprises a carrier having a front side and a backside provided with a plurality of passages therethrough. A circuit board includes a first surface and a second surface. A plurality of light sources are mounted on the first surface and this surface of the circuit board is aligned with the backside of the carrier with the plurality of light sources being aligned with the plurality of passages in one-to-one relationship. At least one heat sink is mounted in thermal contact with at least one of the plurality of light sources.

This lamp assembly provides numerous advantages over the prior art. Clear optics can be used in front of the light sources, which, of course, preferably are LEDs, since only the carrier and LEDs are visible from the front. The carrier can be made of any color or texture to enhance the design. Heat staking or other attachment method gets performed on the metal heat sink, lowering the probability of damaging an LED during the attachment process. The heat sinks are open to the air, thus increasing their efficiency. The flexible PCB is sandwiched between the carrier and the heat sinks leading to a more robust design. The tolerances involved in the heat sinks and the PCB thickness do not add to the tolerance of the LED focal point position. And, the LEDs are partially "caged", that is, by being mounted within the passages in the carrier, they are much less likely to sustain damage during lamp assembly or transport.

BEST MODE FOR CARRYING OUT THE INVENTION

Figure 1:
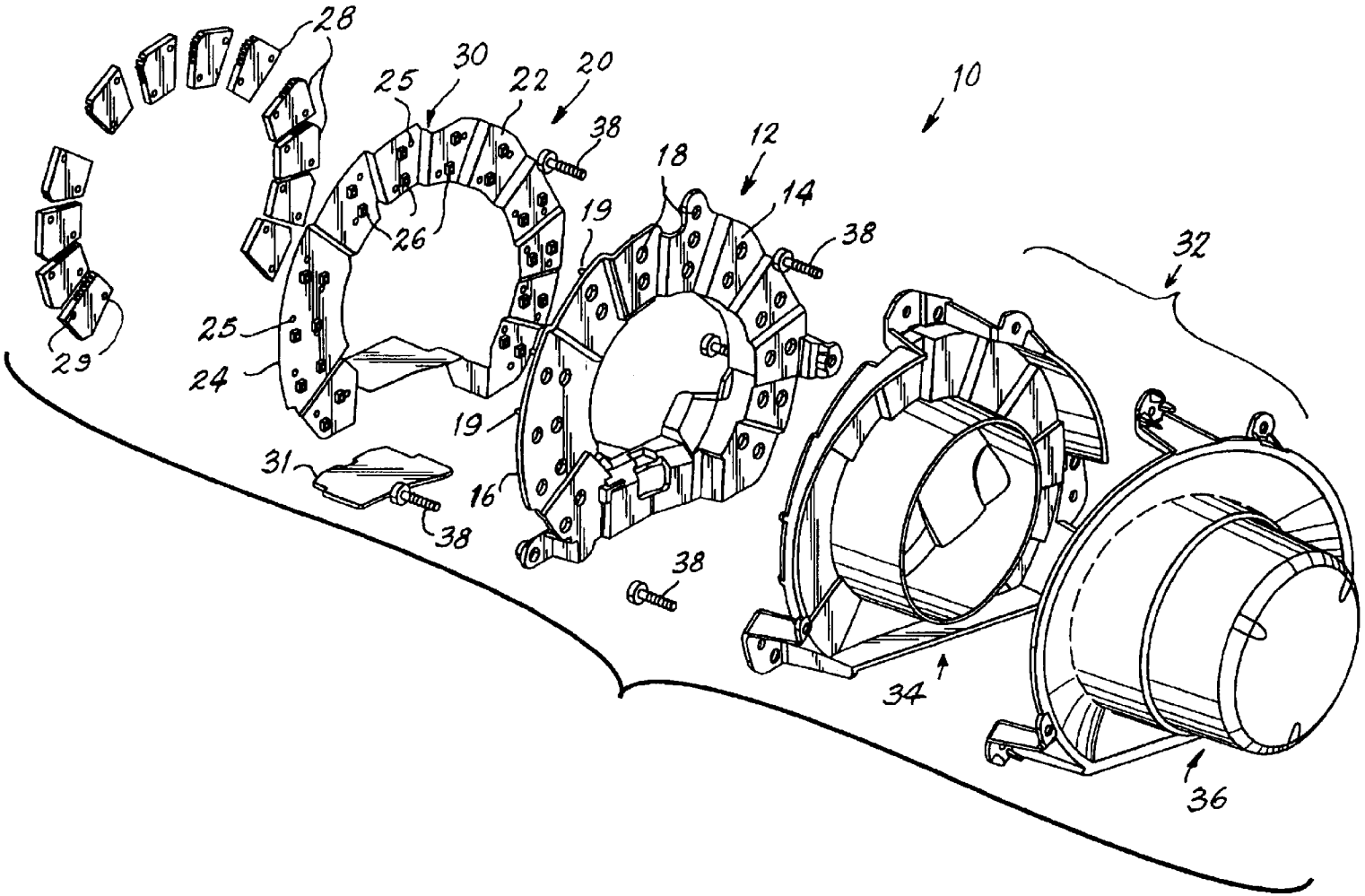
FIG. 1 is an exploded perspective view of a lamp assembly in accordance with an aspect of the invention.

For a better understanding of the present invention, together with other and further objects, advantages and capabilities thereof, reference is made to the following disclosure and appended claims in conjunction with the above-described drawings.

Referring now to FIG. 1 with greater particularity, there is shown a lamp assembly 10 that comprises a substantially annular carrier 12 having a front side 14 and a backside 16. The carrier 12 can be provided with step portions 30 that extend in separate planes and is provided with a plurality of passages 18 therethrough. A plurality of heat stakes 19 project from back side 16 and are used to attach the various parts of the assembly, as will be shown hereafter.

A printed circuit board (PCB) 20, which is preferably flexible and includes a configuration substantially matching that of the carrier 12, includes a first surface 22 and a second surface 24, the former being provided with the necessary electrical circuitry. Apertures 25 for receiving the heat stakes 19 are provided. Light sources 26, which preferably are LEDs, are mounted on the first surface 22 and this surface 22 of the circuit board 20 is aligned with the backside 16 of the carrier with the light sources 26 being aligned with and extending within the passages 18 in one-to-one relationship, providing, as previously noted, protection for the LEDs. Heat sinks 28, which include openings 29, are mounted in thermal contact with the light sources 26 by any desired means, preferably on the second surface 24 of the PCB 20. While the heat sinks are shown as a plurality of individual items, a global heat sink can be employed if desired. An additional heat sink 31 can be provided bridging the gap between the ends of the PCB 20.

The PCB, the carrier, and the heat sinks are fitted together by feeding the heat stakes 19 through apertures 25 and openings 29 and then heat staking. An additional optic assembly 32, which can comprise a housing 34 and lens 36, can be attached to the PCB subassembly and held together by any convenient method, such as bolts 38

There is thus provided a lamp assembly that can employ clear optics since only the LEDs are visible from the front. The visible carrier can be colored or textured to enhance the visual appeal of the lamp assembly. All of the parts can be heat staked together behind the LEDs, thus reducing the possibility of damage to the LEDs. The heat sinks are open to the air and are more efficient and the flexible PCB is sandwiched between the heat sinks and the carrier allowing for a more robust design. This design also protects the LEDs by positioning them within the passages of the carrier.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A lamp assembly comprising:

a carrier having a front side and a backside provided with a plurality of passages therethrough:

a circuit board including a first surface and a second surface; and a plurality of light sources mounted on said first surface, said first surface of said circuit board being aligned with said backside of said carrier, said plurality of light sources being aligned with said plurality of said passages in one-to-one relationship, said carrier and said circuit including mating step portions extending in separate planes.

2. The lamp assembly of claim 1 wherein at least one heat sink 28 is mounted in thermal contact with at least one of said plurality of light sources.

3. The lamp assembly of claim 1 wherein said heat sink is mounted to the second surface of said circuit board.

4. The lamp assembly of claim 1 wherein said heat sink is mounted to said carrier.

5. The lamp assembly of claim 4 wherein said carrier and said circuit board are substantially annular.

6. The lamp assembly of claim 5 wherein a light-transmissive optical assembly is operatively positioned with respect to said light sources.

7. The lamp assembly of claim 1 wherein said light sources are light emitting diodes.

* * * * *